US009469914B2

(12) United States Patent
Thigpen et al.

(10) Patent No.: US 9,469,914 B2
(45) Date of Patent: Oct. 18, 2016

(54) ULTRASOUND ASSISTED ELECTROCHEMICAL CATALYST REMOVAL FOR SUPERHARD MATERIALS

(75) Inventors: Gary M. Thigpen, Houston, TX (US); Federico Bellin, The Woodlands, TX (US); Michael R. Reese, Houston, TX (US)

(73) Assignee: VAREL INTERNATIONAL IND., L.P., Carrollton, TX (US)

( * ) Notice: Subject to any disclaimer, the term of this patent is extended or adjusted under 35 U.S.C. 154(b) by 180 days.

(21) Appl. No.: 13/533,282

(22) Filed: Jun. 26, 2012

(65) Prior Publication Data

US 2013/0001100 A1 Jan. 3, 2013

Related U.S. Application Data

(60) Provisional application No. 61/502,014, filed on Jun. 28, 2011.

(51) Int. Cl.

| | |
|---|---|
| ***C25F 7/00*** | (2006.01) |
| ***C25F 1/00*** | (2006.01) |
| ***C25F 3/02*** | (2006.01) |

(52) U.S. Cl.

CPC .. *C25F 3/02* (2013.01); *C25F 7/00* (2013.01)

(58) Field of Classification Search

CPC ..... E21B 10/46; C25F 5/00; C25B 9/00; C25B 9/06; C25C 7/00; B01J 19/10; C02F 1/34; C02F 1/36; B01D 2259/816

USPC ..... 204/242, 275.1

See application file for complete search history.

(56) References Cited

U.S. PATENT DOCUMENTS 3,151,049 A * 9/1964 Hendry ..... 205/705
3,411,999 A * 11/1968 Weinberg ..... 205/671

(Continued)

FOREIGN PATENT DOCUMENTS

GB 2030599 A * 4/1980 ..... C23G 3/00
GB 2422394 7/2006
GB 2468806 9/2010

OTHER PUBLICATIONS

Copenheaver, Blaine R, International Search Report and Written Opinion of the International Searching Authority for PCT/US2012/044175, Sep. 20, 2012 pp. 1-8.

(Continued)

*Primary Examiner* — Keith Hendricks
*Assistant Examiner* — Salil Jain

(57) ABSTRACT

A catalyst removal apparatus and method for removing catalyst from a polycrystalline cutter. The cutter includes a substrate and a cutting table. The apparatus includes a tank forming a cavity therein, an electrolyte fluid occupying the cavity, the cutter, a covering surrounding at least a portion of the cutter's sidewall and extending from at least the substrate's top surface towards the bottom surface, a cathode submersed within the fluid, and a power source. The cutting table is submersed within the fluid and positioned near the cathode, thereby forming a gap therebetween. The power source is coupled to the cutter and the cathode and electrolyzes the fluid to react with the catalyst in the cutting table to produce a salt. The salt dissolves in the fluid and is removed from the cutter. Optionally, a transducer is sonically coupled to the cutter and emits vibrations to remove salt from the cutting table.

13 Claims, 4 Drawing Sheets

(56) References Cited

U.S. PATENT DOCUMENTS

| | | | | |
|---|---|---|---|---|
| 3,901,786 | A * | 8/1975 | Wheelwright | C25F 7/00 204/225 |
| 4,367,127 | A * | 1/1983 | Messing et al. | 205/566 |
| 5,384,016 | A * | 1/1995 | Lin et al. | 205/478 |
| 5,631,102 | A * | 5/1997 | Spillman et al. | 429/94 |
| 7,866,418 | B2 | 1/2011 | Bertagnolli et al. | |
| 2004/0052593 | A1* | 3/2004 | Anderson | 407/119 |
| 2007/0169419 | A1* | 7/2007 | Davis et al. | 51/293 |
| 2008/0185189 | A1 | 8/2008 | Griffo et al. | |
| 2010/0095602 | A1 | 4/2010 | Belnap et al. | |
| 2010/0236836 | A1 | 9/2010 | Voronin | |
| 2011/0094895 | A1 | 4/2011 | Mazur | |
| 2012/0006691 | A1* | 1/2012 | Luo et al. | 205/645 |

OTHER PUBLICATIONS

M. Jain et al., Processing of Functionally Graded WC/Co/ Diamond Nanocomposites, Scripta Materialia, Aug. 21, 2000, pp. 2099-2103, vol. 44, published by Elsevier Science Ltd.

Cojuhovschi, Oana, Supplementary European Search Report for Application No. EP 12804140.7, Feb. 27, 2015, pp. 1-9, European Patent Office, Munich, Germany.

* cited by examiner

ULTRASOUND ASSISTED ELECTROCHEMICAL CATALYST REMOVAL FOR SUPERHARD MATERIALS

CROSS-REFERENCE TO RELATED APPLICATIONS

This application claims priority to U.S. Provisional Patent Application No. 61/502,014, entitled "Ultrasound Assisted Electrochemical Catalyst Removal For Superhard Materials," filed Jun. 28, 2011, the entirety of which is incorporated by reference herein.

TECHNICAL FIELD

The present invention is directed generally to components having a polycrystalline structure with a catalyst material deposited therein; and more particularly, to an apparatus and method for removing at least a portion of the catalyst material from these components.

BACKGROUND

Polycrystalline diamond compacts ("PDC") have been used in industrial applications, including rock drilling applications and metal machining applications. Such compacts have demonstrated advantages over some other types of cutting elements, such as better wear resistance and impact resistance. The PDC can be formed by sintering individual diamond particles together under the high pressure and high temperature ("HPHT") conditions referred to as the "diamond stable region," which is typically above forty kilobars and between 1,200 degrees Celsius and 2,000 degrees Celsius, in the presence of a catalyst/solvent which promotes diamond-diamond bonding. Some examples of catalyst/solvents for sintered diamond compacts are cobalt, nickel, iron, and other Group VIII metals. PDCs usually have a diamond content greater than seventy percent by volume, with about eighty percent to about ninety-eight percent being typical. An unbacked PDC can be mechanically bonded to a tool (not shown), according to one example. Alternatively, the PDC is bonded to a substrate, thereby forming a PDC cutter, which is typically insertable within a downhole tool (not shown), such as a drill bit or a reamer.

FIG. 1 shows a side view of a PDC cutter 100 having a polycrystalline diamond ("PCD") cutting table 110, or compact, in accordance with the prior art. Although a PCD cutting table 110 is described in the exemplary embodiment, other types of cutting tables, including polycrystalline boron nitride ("PCBN") compacts, are used in alternative types of cutters. Referring to FIG. 1, the PDC cutter 100 typically includes the PCD cutting table 110 and a substrate 150 that is coupled to the PCD cutting table 110. The PCD cutting table 110 is about one tenth of an inch (2.5 millimeters) thick; however, the thickness is variable depending upon the application in which the PCD cutting table 110 is to be used.

The substrate 150 includes a top surface 152, a bottom surface 154, and a substrate outer wall 156 that extends from the circumference of the top surface 152 to the circumference of the bottom surface 154. The PCD cutting table 110 includes a cutting surface 112, an opposing surface 114, and a PCD cutting table outer wall 116 that extends from the circumference of the cutting surface 112 to the circumference of the opposing surface 114. The opposing surface 114 of the PCD cutting table 110 is coupled to the top surface 152 of the substrate 150. Typically, the PCD cutting table 110 is coupled to the substrate 150 using a high pressure and high temperature ("HPHT") press. However, other methods known to people having ordinary skill in the art can be used to couple the PCD cutting table 110 to the substrate 150. In one embodiment, upon coupling the PCD cutting table 110 to the substrate 150, the cutting surface 112 of the PCD cutting table 110 is substantially parallel to the substrate's bottom surface 154. Additionally, the PDC cutter 100 has been illustrated as having a right circular cylindrical shape; however, the PDC cutter 100 is shaped into other geometric or non-geometric shapes in other exemplary embodiments. In certain exemplary embodiments, the opposing surface 114 and the top surface 152 are substantially planar; however, the opposing surface 114 and the top surface 152 is non-planar in other exemplary embodiments. Additionally, according to some exemplary embodiments, a bevel (not shown) is formed around at least the circumference of the cutting surface 112.

According to one example, the PDC cutter 100 is formed by independently forming the PCD cutting table 110 and the substrate 150, and thereafter bonding the PCD cutting table 110 to the substrate 150. Alternatively, the substrate 150 is initially formed and the PCD cutting table 110 is subsequently formed on the top surface 152 of the substrate 150 by placing polycrystalline diamond powder onto the top surface 152 and subjecting the polycrystalline diamond powder and the substrate 150 to a high temperature and high pressure process. Alternatively, the substrate 150 and the PCD cutting table 110 are formed and bonded together at about the same time. Although a few methods of forming the PDC cutter 100 have been briefly mentioned, other methods known to people having ordinary skill in the art can be used.

According to one example for forming the PDC cutter 100, the PCD cutting table 110 is formed and bonded to the substrate 150 by subjecting a layer of diamond powder and a mixture of tungsten carbide and cobalt powders to HPHT conditions. The cobalt is typically mixed with tungsten carbide and positioned where the substrate 150 is to be formed. The diamond powder is placed on top of the cobalt and tungsten carbide mixture and positioned where the PCD cutting table 110 is to be formed. The entire powder mixture is then subjected to HPHT conditions so that the cobalt melts and facilitates the cementing, or binding, of the tungsten carbide to form the substrate 150. The melted cobalt also diffuses, or infiltrates, into the diamond powder and acts as a catalyst for synthesizing diamond bonds and forming the PCD cutting table 110. Thus, the cobalt acts as both a binder for cementing the tungsten carbide and as a catalyst/solvent for sintering the diamond powder to form diamond-diamond bonds. The cobalt also facilitates in forming strong bonds between the PCD cutting table 110 and the cemented tungsten carbide substrate 150.

Cobalt has been a preferred constituent of the PDC manufacturing process. Traditional PDC manufacturing processes use cobalt as the binder material for forming the substrate 150 and also as the catalyst material for diamond synthesis because of the large body of knowledge related to using cobalt in these processes. The synergy between the large bodies of knowledge and the needs of the process have led to using cobalt as both the binder material and the catalyst material. However, as is known in the art, alternative metals, such as iron, nickel, chromium, manganese, and tantalum, and other suitable materials, can be used as a catalyst for diamond synthesis. When using these alternative materials as a catalyst for diamond synthesis to form the PCD cutting table 110, cobalt, or some other material such as nickel chrome or iron, is typically used as the binder material for cementing the tungsten carbide to form the substrate 150. Although some materials, such as tungsten carbide and cobalt, have been provided as examples, other materials known to people having ordinary skill in the art can be used to form the substrate 150, the PCD cutting table 110, and form bonds between the substrate 150 and the PCD cutting table 110.

FIG. 2 is a schematic microstructural view of the PCD cutting table 110 of FIG. 1 in accordance with the prior art. Referring to FIGS. 1 and 2, the PCD cutting table 110 has diamond particles 210 bonded to other diamond particles 210, one or more interstitial spaces 212 formed between the diamond particles 210, and cobalt 214 deposited within the interstitial spaces 212. During the sintering process, the interstitial spaces 212, or voids, are formed between the carbon-carbon bonds and are located between the diamond particles 210. The diffusion of cobalt 214 into the diamond powder results in cobalt 214 being deposited within these interstitial spaces 212 that are formed within the PCD cutting table 110 during the sintering process.

Once the PCD cutting table 110 is formed and placed into operation, the PCD cutting table 110 is known to wear quickly when the temperature reaches a critical temperature. This critical temperature is about 750 degrees Celsius and is reached when the PCD cutting table 110 is cutting rock formations or other known materials. The high rate of wear is believed to be caused by the differences in the thermal expansion rate between the diamond particles 210 and the cobalt 214 and also by the chemical reaction, or graphitization, that occurs between cobalt 214 and the diamond particles 210. The coefficient of thermal expansion for the diamond particles 210 is about $1.0\times10^{-6}$ millimeters$^{-1}\times$ Kelvin$^{-1}$ ("mm$^{-1}$K$^{-1}$"), while the coefficient of thermal expansion for the cobalt 214 is about $13.0\times10^{-6}$ mm$^{-1}$K$^{-1}$. Thus, the cobalt 214 expands much faster than the diamond particles 210 at temperatures above this critical temperature, thereby making the bonds between the diamond particles 210 unstable. The PCD cutting table 110 becomes thermally degraded at temperatures above about 750 degrees Celsius and its cutting efficiency deteriorates significantly.

Efforts have been made to slow the wear of the PCD cutting table 110 at these high temperatures. These efforts include performing conventional acid leaching processes of the PCD cutting table 110 which removes some of the cobalt 214 from the interstitial spaces 212. Conventional leaching processes involve the presence of an acid solution (not shown) which reacts with the cobalt 214, or other binder/catalyst material, that is deposited within the interstitial spaces 212 of the PCD cutting table 110. These acid solutions typically consist of highly concentrated solutions of hydrofluoric acid (HF), nitric acid ($HNO_3$), and/or sulfuric acid ($H_2SO_4$). These highly concentrated acid solutions are hazardous to individuals handling these solutions. According to one example of a conventional leaching process, the PDC cutter 100 is placed within an acid solution such that at least a portion of the PCD cutting table 110 is submerged within the acid solution. The acid solution reacts with the cobalt 214, or other binder/catalyst material, along the outer surfaces of the PCD cutting table 110. The acid solution slowly moves inwardly within the interior of the PCD cutting table 110 and continues to react with the cobalt 214. However, as the acid solution moves further inwards, the reaction byproducts become increasingly more difficult to remove; and hence, the rate of leaching slows down considerably within these conventional leaching processes. For this reason, a tradeoff occurs between conventional leaching process duration and the desired leaching depth, wherein costs increase as the conventional leaching process duration increases. Thus, the leaching depth is typically about 0.2 millimeters, which takes about days to achieve this depth. However, the leached depth can be more or less depending upon the PCD cutting table 110 requirements and/or the cost constraints. The removal of cobalt 214 alleviates the issues created due to the differences in the thermal expansion rate between the diamond particles 210 and the cobalt 214 and due to graphitization. However, the conventional leaching processes are costly due to the length of time required.

BRIEF DESCRIPTION OF THE DRAWINGS

The foregoing and other features and aspects of the invention are best understood with reference to the following description of certain exemplary embodiments, when read in conjunction with the accompanying drawings, wherein.

Figure 1:
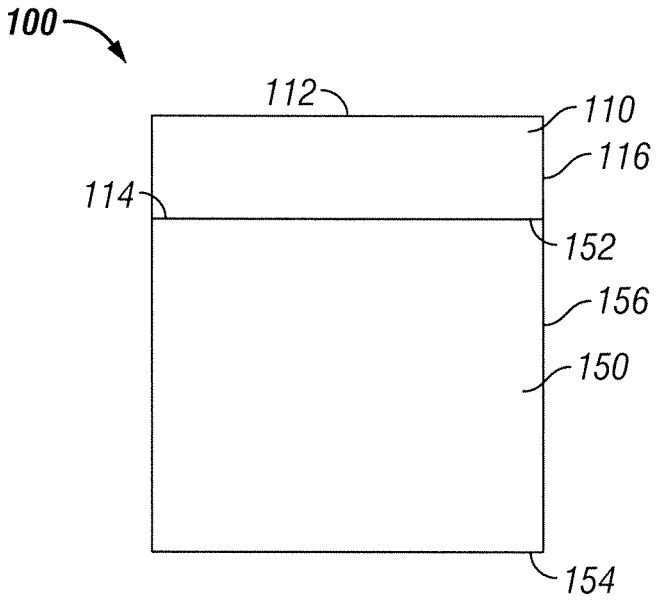
FIG. 1 shows a side view of a PDC cutter having a PCD cutting table in accordance with the prior art.

The drawings illustrate only exemplary embodiments of the invention and are therefore not to be considered limiting of its scope, as the invention may admit to other equally effective embodiments.

BRIEF DESCRIPTION OF EXEMPLARY EMBODIMENTS

The present invention is directed generally to components having a polycrystalline structure with a catalyst material deposited therein; and more particularly, to an apparatus and method for removing at least a portion of the catalyst material from these components. Although the description of exemplary embodiments is provided below in conjunction with a polycrystalline diamond compact ("PDC") cutter, alternate embodiments of the invention may be applicable to other types of cutters or components including, but not limited to, polycrystalline boron nitride ("PCBN") cutters or PCBN compacts. As previously mentioned, the compact is mountable to a substrate to form a cutter or is mountable directly to a tool for performing cutting processes. The invention is better understood by reading the following description of non-limiting, exemplary embodiments with reference to the attached drawings, wherein like parts of each of the figures are identified by like reference characters, and which are briefly described as follows.

Figure 3:
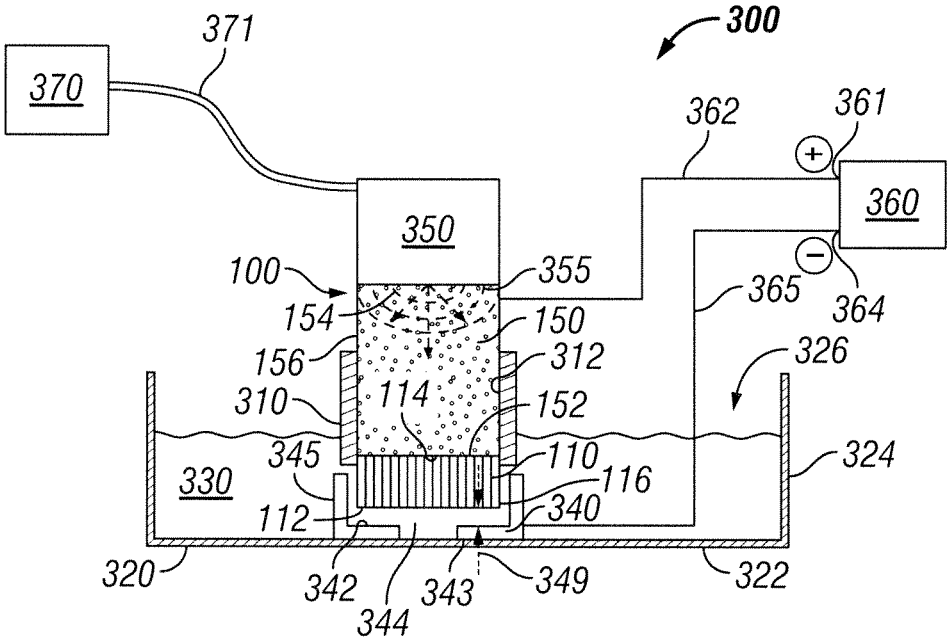
FIG. 3 is a cross-sectional view of a catalyst removal apparatus in accordance with an exemplary embodiment.

FIG. 3 is a cross-sectional view of a catalyst removal apparatus 300 in accordance with an exemplary embodiment. Referring to FIG. 3, the catalyst removal apparatus 300 includes the PDC cutter 100, a covering 310, an immersion tank 320, an electrolyte fluid 330, a cathode 340, a transducer 350, and at least one power source 360.

Figure 2:
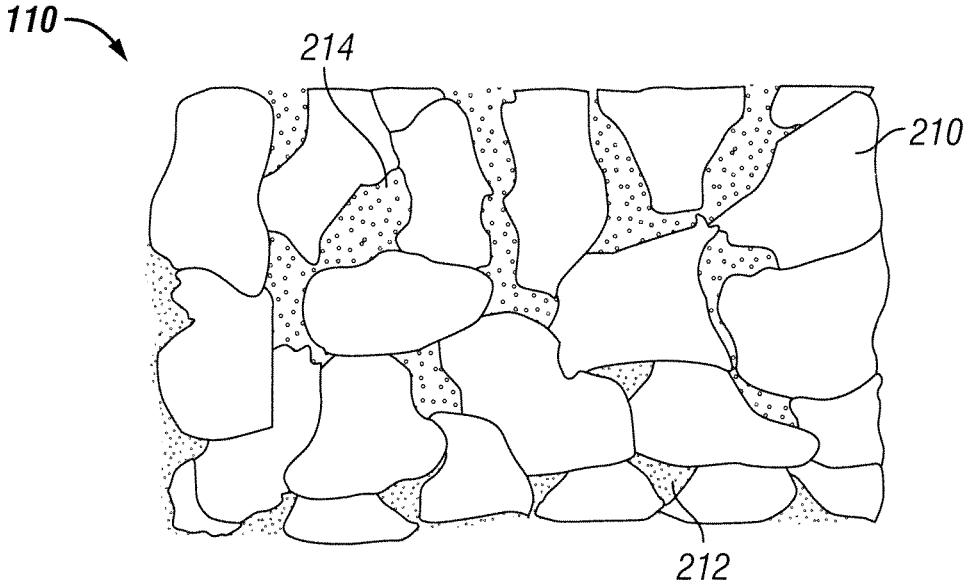
FIG. 2 is a schematic microstructural view of the PCD cutting table of FIG. 1 in accordance with the prior art.

The PDC cutter 100 has been previously described with respect to FIGS. 1 and 2 above. Referring to FIGS. 1-3, the PDC cutter 100 includes the PCD cutting table 110 and the substrate 150 that is coupled to the PCD cutting table 110. Although the PCD cutting table 110 is described in the exemplary embodiment, other types of cutting tables, including PCBN compacts, are used in alternative types of cutters. The PCD cutting table 110 is about one tenth of an inch (2.5 millimeters) thick; however, the thickness is variable depending upon the application in which the PCD cutting table 110 is to be used.

The substrate 150 includes the top surface 152, the bottom surface 154, and the substrate outer wall 156 that extends from the circumference of the top surface 152 to the circumference of the bottom surface 154. The PCD cutting table 110 includes the cutting surface 112, the opposing surface 114, and the PCD cutting table outer wall 116 that extends from the circumference of the cutting surface 112 to the circumference of the opposing surface 114. The opposing surface 114 of the PCD cutting table 110 is coupled to the top surface 152 of the substrate 150 according to methods known to people having ordinary skill in the art, some of which have been previously described above. The shape and geometry of the PDC cutter 100 can be varied according to the descriptions previously provided or according to the knowledge known to people having ordinary skill in the art.

Upon formation of the PDC cutter 100 and in accordance with some exemplary embodiments, the substrate 150 includes tungsten carbide and cobalt, or some other binding compound such as nickel chrome or iron. Also, upon formation of the PDC cutter 100 and in accordance with some exemplary embodiments, the PCD cutting table 110 includes diamond particles 210 bonded to one another and cobalt 214, or some other catalyst material such as iron, nickel, chromium, manganese, and tantalum, deposited within the interstitial spaces 212 formed between the diamond-diamond bonds during the sintering process. Although some materials, such as tungsten carbide and cobalt, have been provided as an example, other materials known to people having ordinary skill in the art can be used to form the substrate 150. Also, although some materials, such as diamond particles and cobalt, have been provided as an example, other materials known to people having ordinary skill in the art can be used to form the PCD cutting table 110.

Referring to FIG. 3 and as previously mentioned, the catalyst removal apparatus 300 includes the covering 310. The covering 310 is annularly shaped and forms a channel 312 therein. The covering 310 surrounds at least a portion of the substrate outer wall 156 extending from about the perimeter of the top surface 152 towards the bottom surface 154. In some exemplary embodiments, a portion of the covering 310 also surrounds a portion of the perimeter of the PCD cutting table outer wall 116 extending from the perimeter of the opposing surface 114 towards the cutting surface 112. Thus, the cutting surface 112 and at least a portion of the PCD cutting table outer wall 116 is exposed and not concealed by the covering 310 in certain exemplary embodiments. The covering 310 is fabricated using epoxy resin; however, other suitable materials, such as a plastic, porcelain, or Teflon®, can be used without departing from the scope and spirit of the exemplary embodiment. In some exemplary embodiments, the covering 310 is positioned around at least a portion of the PDC cutter 100 by inserting the PDC cutter 100 through the channel 312 of the covering 310. The covering 310 is friction fitted to the PDC cutter 100 in some exemplary embodiments, while in other exemplary embodiments, the covering 310 is securely positioned by placing an o-ring (not shown), or other suitable known device, around the PDC cutter 100 and inserting the PDC cutter 100 and the coupled o-ring into the covering 310 so that the o-ring is inserted into a circumferential groove (not shown) formed within the internal surface of the covering 310. In an alternative exemplary embodiment, the covering 310 is circumferentially applied onto the substrate outer wall 156 and/or the PCD cutting table outer wall 116 of the PDC cutter 100. Although some methods for securing the covering 310 to the PDC cutter 100 have been described, other methods known to people having ordinary skill in the art can be used without departing from the scope and spirit of the exemplary embodiment. The covering 310 protects the surface of the substrate outer wall 156 and/or at least a portion of the PCD cutting table outer wall 116 to which it is applied from being exposed to the electrolyte fluid 330, which is discussed in further detail below.

The immersion tank 320 includes a base 322 and a surrounding wall 324 extending substantially perpendicular around the perimeter of the base 322, thereby forming a cavity 326 therein. According to certain exemplary embodiments, the base 322 is substantially planar; however, the base 322 is non-planar in other exemplary embodiments. Also in alternative exemplary embodiments, the surrounding wall 324 is non-perpendicular to the base 322. Also, the immersion tank 320 is formed having a rectangular shape. Alternatively, the immersion tank 320 is formed having any other geometric shape or non-geometric shape. In some exemplary embodiments, the immersion tank 320 is fabricated using a plastic material; however, other suitable materials, such as metal, metal alloys, or glass, are used in other exemplary embodiments. The material used to fabricate the immersion tank 320 is typically non-corrosive and does not react with the electrolyte fluid 330.

The electrolyte fluid 330 is placed within the cavity 326 of the immersion tank 320 and filled to a depth of at least the thickness of the PCD cutting table 110. The electrolyte fluid 330 is a solution that is able to react with the catalyst material 214 (FIG. 2), for example cobalt 214, used in forming the PCD cutting table 110 and present within the interstitial spaces 212 (FIG. 2) of the PDC cutter 100. The electrolyte fluid 330 is a diluted hydrochloric acid (HCl) solution according to one example, but can be other diluted or concentrated solutions of mineral (or inorganic) acids. In certain exemplary embodiments, sulfonic and carboxylic acids are used as the electrolyte fluid 330.

In certain exemplary embodiments, the diluted HCl solution is about five percent by weight HCl and about ninety-five percent by weight water; however, the diluted HCl solution is in other concentrations of HCl and/or is mixed with other fluids to form the electrolyte fluid 330 in other exemplary embodiments. For example, the diluted HCl solution includes hydrochloric acid ranging from about two weight percent to about fifteen weight percent. The electrolyte fluid 330 is able to react with the catalyst material within the PCD cutting table 110 and form a product, or salt, that is soluble within the electrolyte fluid 330. For instance, when the catalyst material 214 (FIG. 2) is cobalt and the electrolyte fluid 330 is a diluted HCl solution, the HCl reacts with the cobalt to form cobalt chloride ($CoCl_2$), which is soluble within water, which is a component of the electrolyte fluid 330. Thus, the electrolyte fluid 330 is any acidic solution capable of reacting with the catalyst material 214 (FIG. 2) to form a product, or salt, that is soluble within the electrolyte fluid 330. According to some exemplary embodiments, the solubility of the product in the electrolyte fluid 330 is 10 grams/100 milliliters or higher. In certain exemplary embodiments, the electrolyte fluid 330 is a diluted acid solution, and not a concentrated acid solution typically used in conventional leaching processes; however, some exemplary embodiments can use the concentrated acid solutions such as HF, $HNO_3$, and/or $H_2SO_4$. Diluted acid solutions are used as the electrolyte fluid 330 in some exemplary embodiments to reduce health hazards posed to individuals handling the electrolyte fluid 330 and yet are still effective at removing the catalyst material 214 (FIG. 2) from the PCD cutting table 110.

In certain exemplary embodiments, the electrolyte fluid 330 is formed from a more complex system where mineral and/or carboxylic and/or sulfonic acids are mixed in different ratios in an aqueous solution to increase the speed of the electrolytic process. In certain alternative exemplary embodiments, acid salts, such as sodium bicarbonate, sodium hydrosulfide, sodium bisulfate, and monosodium phosphate are mixed and dissolved in an aqueous solution to form the electrolyte fluid 330. In a further alternative exemplary embodiment, the electrolyte fluid 330 is a basic aqueous solution, such as a strong basic solution or a basic salt. Examples of a strong basic solution includes, but is not limited to, potassium hydroxide, barium hydroxide, caesium hydroxide, sodium hydroxide, strontium hydroxide, calcium hydroxide, magnesium hydroxide, lithium hydroxide, and rubidium hydroxide. Examples of basic salts include, but are not limited to, calcium carbonate and sodium carbonate. In yet other exemplary embodiments, the electrolyte fluid 330 is a molten salt bath, in lieu of an aqueous solution. Any ionic compound that would melt at a temperature of less than about 800° C., such as potassium chloride which has a melting point of about 772° C., is used within this process. In the molten state, the ions are free to move and the catalyst dissolution process occurs.

The cathode 340 includes a base 341 having a first surface 342 and a second surface 343 facing an opposite direction than the first surface 342. The base 341 is substantially circular in shape; however, the base 341 is shaped differently in other exemplary embodiments. The base 341 also includes an aperture 344 extending from the first surface 342 to the second surface 343 according to certain exemplary embodiments; however, the aperture 344 is not present in other exemplary embodiments. The aperture 344 is centrally positioned within the base 341, but can be positioned elsewhere in the base 341. According to certain exemplary embodiments, the base 341 is substantially planar; however, the base 341 is non-planar in other exemplary embodiments. According to some exemplary embodiments, the cathode 340 also includes a sidewall 345 extending substantially perpendicular around the perimeter of the base 341 and extending from the first surface 342. In alternative exemplary embodiments, the sidewall 345 extends non-perpendicular to the base 341. The cathode 340 is fabricated using platinum; however, other suitable materials, such as gold, palladium, other precious metals, and other noble metals, are used in other exemplary embodiments. The material used to fabricate the cathode 340 is relatively corrosion resistant. The cathode 340 is immersed within the electrolyte fluid 330 and positioned on or adjacent to the base 322 of the immersion tank 320. Although a few exemplary geometries of the cathode 340 have been described, the geometry of the cathode 340 can be varied to increase or decrease the electric field near the PDC cutter 100 once coupled to a circuit 390, which is formed using the cathode 340, the PDC cutter 100, the electrolyte fluid 330, and the first power source 360.

Once the cathode 340 has been positioned within the immersion tank 320 and immersed within the electrolyte fluid 330, at least a portion of the PDC cutter 100 along with a portion of the covering 310 also are immersed into the electrolyte fluid 330. Specifically, the PCD cutting table 110 is immersed into the electrolyte fluid 330 and positioned near the base 341 wherein the profile of the perimeter of the PCD cutting table 110 is surrounded by the profile of the perimeter of the base 341. Also, a gap 349 is formed between the cutting surface 112 and the base 341. The gap 349 allows the electrolyte fluid 330 to be in contact with at least a portion of the PCD cutting table 110. The gap 349 ranges from about 1 millimeter to about 10 millimeters; however the size of the gap 349 is increased or decreased in other exemplary embodiments. In certain exemplary embodiments, the cutting surface 112 is positioned near and substantially parallel to the first surface 342 of the cathode 340. Also, in certain exemplary embodiments, the sidewall 345 of the cathode 340 surrounds at least a portion of the PCD cutting table outer wall 116.

The first power source 360 includes a positive terminal 361 and a negative terminal 364. The positive terminal 361 is electrically coupled to the substrate 150, which behaves as an anode, using a first electrically conducting wire 362, while the negative terminal 364 is electrically coupled to the cathode 340 using a second electrically conducting wire 365. The first power source 360 provides current to electrolyze the electrolyte fluid 330, and thereby facilitate the reaction of the electrolyte fluid 330 with the cobalt, or other catalyst material 214 (FIG. 2), used to form the PCD cutting table 110. The detail process of removing at least a portion of the cobalt from the PCD cutting table 110 is described in further detail below. According to some exemplary embodiments, the first power source 360 has an output of about fifteen AC Volts and supplies a current at about one milliamp. However, the voltage and/or the current is different in other exemplary embodiments depending upon the materials used to form the cutting table 110 and the materials used to form the electrolyte fluid 330.

The transducer 350 is coupled to the PDC cutter 100 according to some exemplary embodiments. According to some exemplary embodiments, a portion of the transducer 350 is coupled to the bottom surface 154 of the PDC cutter 100; however the transducer 350 can be coupled to a portion of the substrate outer wall 156 in other exemplary embodiments. Alternatively, the transducer 350 is coupled to a portion of the immersion tank 320 or positioned within the electrolyte fluid 330, thereby producing vibrations which propagate through the electrolyte fluid 330 and into the PDC cutter 100. The transducer 350 also is coupled to a second power source 370 using a third electrical wire 371. The transducer 350 converts electric current supplied from the second power source 370 into vibrations that are propagated through the PDC cutter 100. The transducer 350 is shaped into a cylindrical shape and has a circumference sized approximately similarly to the circumference of the bottom surface 154. However, the shape and size of the transducer 350 varies in other exemplary embodiments. The transducer 350 is a piezoelectric transducer; however, the transducer 350 is a magnetostrictive transducer in other exemplary embodiments. The transducer 350 operates at a frequency of about 40 kilohertz (kHz) in some exemplary embodiments. In other exemplary embodiments, the transducer 350 operates at a frequency ranging from about 20 kHz to about 50 kHz; yet, in still other exemplary embodiments, the operating frequency is higher or lower than the provided range. The transducer 350 supplies ultrasonic vibrations 355 which propagate through the PDC cutter 100 and facilitate the CoCl removal from the interstitial spaces 212 (FIG. 2) formed within the PCD cutting table 110, which is further described below. In some exemplary embodiments, the second power source 370 is not provided and the power to the transducer 350 is supplied from the first power source 360.

Once the catalyst removal apparatus 300 has been set up, the first power source 360 is powered "on" to facilitate the electrolysis of the electrolyte fluid 330. The first power source 360 is adjusted to a desired voltage differential value to facilitate the dissolution of cobalt, or the catalyst material 214 (FIG. 2) in the electrolyte fluid 330. In certain exemplary embodiments, the desired voltage differential value is optimized, thereby maximizing the dissolution of cobalt, or the catalyst material 214 (FIG. 2) in the electrolyte fluid 330. In the exemplary embodiments using diluted HCl solution mixed with water as the electrolyte fluid 330, oxygen gas is formed at the PDC cutter 100, or anode, and hydrogen gas is formed at the cathode 340. The chlorine ions are separated from the hydrogen ions and are present within the electrolyte fluid 330. The electrolyte fluid 330 enters into the interstitial spaces 212 (FIG. 2) of the PCD cutter table 110, where the chlorine ions react with the cobalt ions located therein. The reaction forms $CoCl_2$, which is a cobalt salt that is highly soluble within the electrolyte fluid 330. This high solubility of the product salt, for example $CoCl_2$, prevents or reduces the clogging of any solid byproducts formed during the reaction. The $CoCl_2$ is removed from the interstitial spaces 212 and out of the PCD cutting table 110.

In certain exemplary embodiments, the transducer 350 and the second power source 370 are included in the catalyst removal apparatus 300 according to the description provided above. The second power source 370 is turned "on" to facilitate removal of the $CoCl_2$ from the PCD cutting table 110 back into the electrolyte fluid 330. The transducer 350 produces ultrasonic vibrations 355 into the PDC cutter 100 which promotes the removal of the $CoCl_2$ from the PCD cutting table 110 back into the electrolyte fluid 330. The operating frequency of the transducer 350 and the intensity of the elastic waves emitted from the transducers can be adjusted to maximize the amount of vibrations 355 delivered to the PCD cutting table 110. Furthermore, the ultrasonic vibrations 355 mechanically improve the electrolyte fluid 330 circulation rate into and out of the interstitial spaces 212 (FIG. 2), thereby providing fresh, yet unreacted, electrolyte fluid 330 into the interstitial spaces 212 (FIG. 2). Once the $CoCl_2$ is removed from the PCD cutting table 110, the electrolyte fluid 330 is able to proceed deeper into the PCD cutting table 110 and react with more cobalt located within additional interstitial voids 212 (FIG. 2). Hence, the electrolyte fluid 330 is able to move inwardly within the interior of the PCD cutting table 110 at a faster rate than conventional leaching methods. The time expended for removing the catalyst from the PCD cutting table 110 at a 0.2 millimeter depth using the catalyst removal apparatus 300 and the method provided herein is about three hours, while the time expended to leach to the same depth using conventional leaching methods is several days. Thus, the faster catalyst removal rate translates into cost savings because the catalyst removed components are manufactured faster and therefore are used in the field faster.

Although a single PDC cutter 100 and corresponding cathode 340 is shown to be immersed in the electrolyte fluid 330, several PDC cutters 100 with corresponding cathodes 340 can be immersed into the electrolyte fluid 330 to remove the catalyst material 212 (FIG. 2) from the PCD cutting table 110 simultaneously. Alternatively, a cathode tray (not shown) having several recessed regions (not shown) can be used in lieu of the cathode 340. Each of the recessed region is capable of receiving at least a portion of the PCD cutting table 110 of a respective PDC cutter 100.

Figure 4:
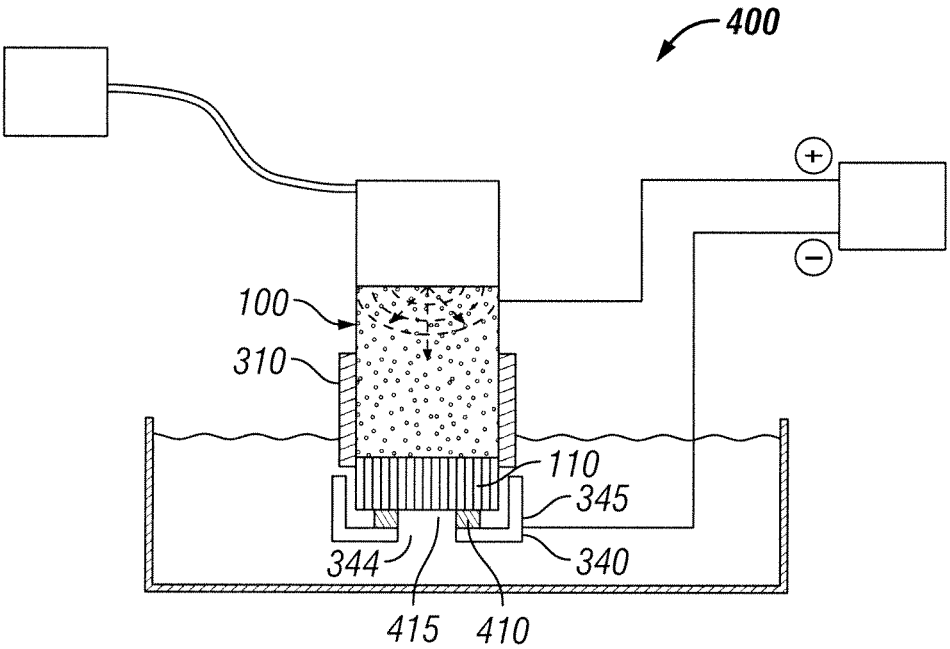
FIG. 4 is a cross-sectional view of a catalyst removal apparatus in accordance with another exemplary embodiment.

FIG. 4 is a cross-sectional view of a catalyst removal apparatus 400 in accordance with another exemplary embodiment. The catalyst removal apparatus 400 is similar to the catalyst removal apparatus 300 (FIG. 3) except that catalyst removal apparatus 400 includes a porous material 410 that is used to couple the cathode 340 to the PDC cutter 100 in a fixed relationship. In some exemplary embodiments, the porous material 410 is positioned between the PCD cutting table 110 and the cathode 340 and coupled to each of the PCD cutting table 110 and the cathode 340. Alternatively, the porous material 410 is positioned between the covering 310 and the cathode 340 and coupled to each of the covering 310 and the cathode 340. In these alternative exemplary embodiments, the perimeter of the cathode's sidewall 345 is larger than the perimeter of the covering 310 and cathode's sidewall 345 vertically overlaps with a portion of the covering 310. The porous material 410 is annularly shaped and is formed with a channel 415 therein. In some exemplary embodiments, the channel 415 is sized similarly to the size of the channel 344 formed within the cathode 340 and is vertically aligned with the channel 344. The perimeter of the porous material 410 is smaller than the perimeter of the PCD cutting table 110 according to certain exemplary embodiments. The porous material 410 is fabricated using a sponge, for example; however, other materials known to people having ordinary skill in the art can be used to couple the cathode 340 in a fixed relationship with the PDC cutter 100. This exemplary embodiment allows both the PDC cutter 100 and the cathode 340 to be suspended a distance from the base 322 of the immersion tank 320. Additional embodiments described with respect to the catalyst removal apparatus 300 (FIG. 3) above are applicable to the catalyst removal apparatus 400 and can be used to modify the catalyst removal apparatus 400 accordingly.

Figure 5:
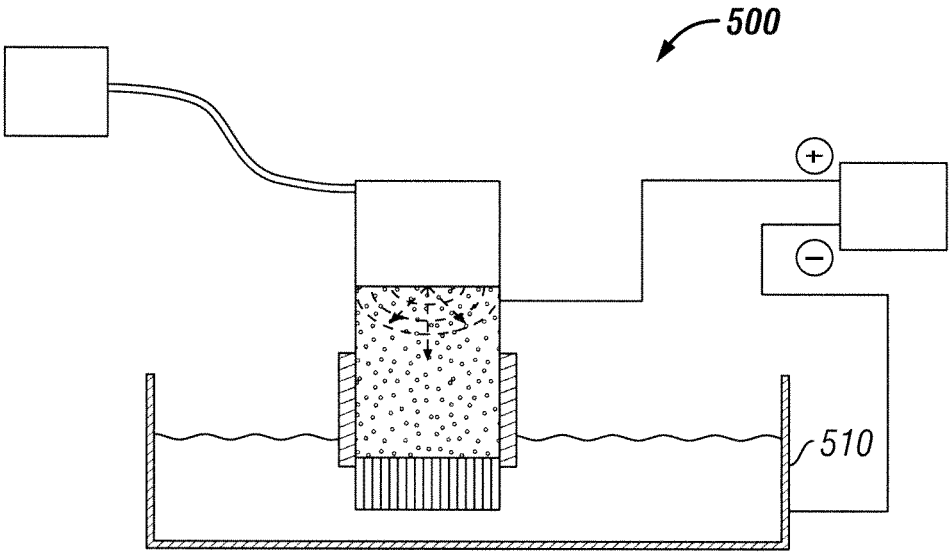
FIG. 5 is a cross-sectional view of a catalyst removal apparatus in accordance with another exemplary embodiment.

FIG. 5 is a cross-sectional view of a catalyst removal apparatus 500 in accordance with another exemplary embodiment. The catalyst removal apparatus 500 is similar to the catalyst removal apparatus 300 (FIG. 3) except that catalyst removal apparatus 500 integrates the cathode 340 (FIG. 3) into the immersion tank 320 (FIG. 3) to form a cathode immersion tank 510. The cathode immersion tank 510 is similar to the immersion tank 320 (FIG. 3), except that the cathode immersion tank 510 is fabricated using materials used to fabricate the cathode 340 (FIG. 3). Thus, the negative terminal 364 of the first power source 360 is electrically coupled to the cathode immersion tank 510. The operation of the catalyst removal apparatus 500 is similar to the operation of the catalyst removal apparatus 300 (FIG. 3). Additional embodiments described with respect to the catalyst removal apparatus 300 (FIG. 3) above are applicable to the catalyst removal apparatus 500 and can be used to modify the catalyst removal apparatus 500 accordingly.

Figure 6:
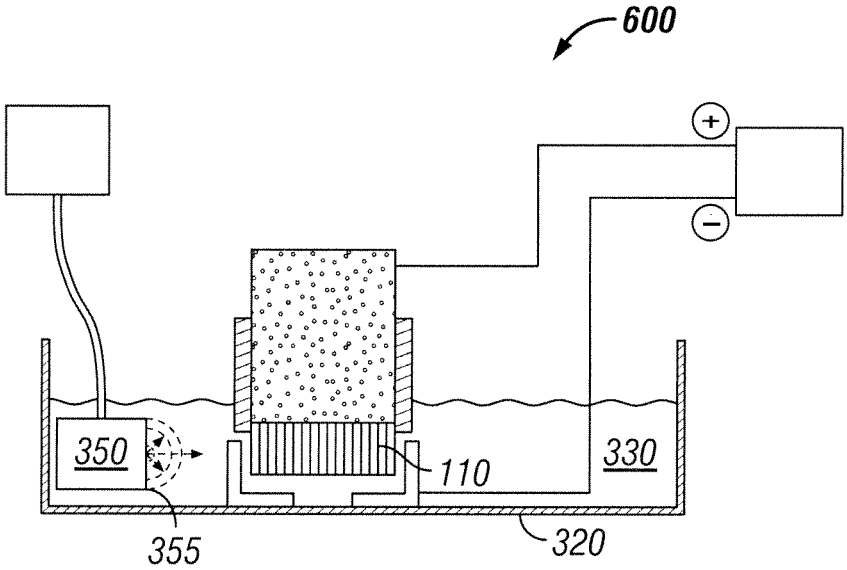
FIG. 6 is a cross-sectional view of a catalyst removal apparatus in accordance with another exemplary embodiment.

FIG. 6 is a cross-sectional view of a catalyst removal apparatus 600 in accordance with another exemplary embodiment. The catalyst removal apparatus 600 is similar to the catalyst removal apparatus 300 (FIG. 3) except that the transducer 350 of the catalyst removal apparatus 600 is submerged within the electrolyte fluid 330. The transducer 350 transmits ultrasonic vibrations 355 into the electrolyte fluid 330, which then transmits the vibrations 355 into the PCD cutting table 110. As previously mentioned, the ultrasonic vibrations 355 facilitate removal of the reaction product, or salt, within the interstitial void 212 (FIG. 2) and increases the recirculation rate of the fresh, and unreacted, electrolyte fluid 330 into the PCD cutting table 110. Thus, the catalyst removal rate is substantially increased. Alternatively, the transducer 350 is coupled to a portion of the immersion tank 320. Additional embodiments described with respect to the catalyst removal apparatus 300 (FIG. 3) above are applicable to the catalyst removal apparatus 600 and can be used to modify the catalyst removal apparatus 600 accordingly.

Figure 7:
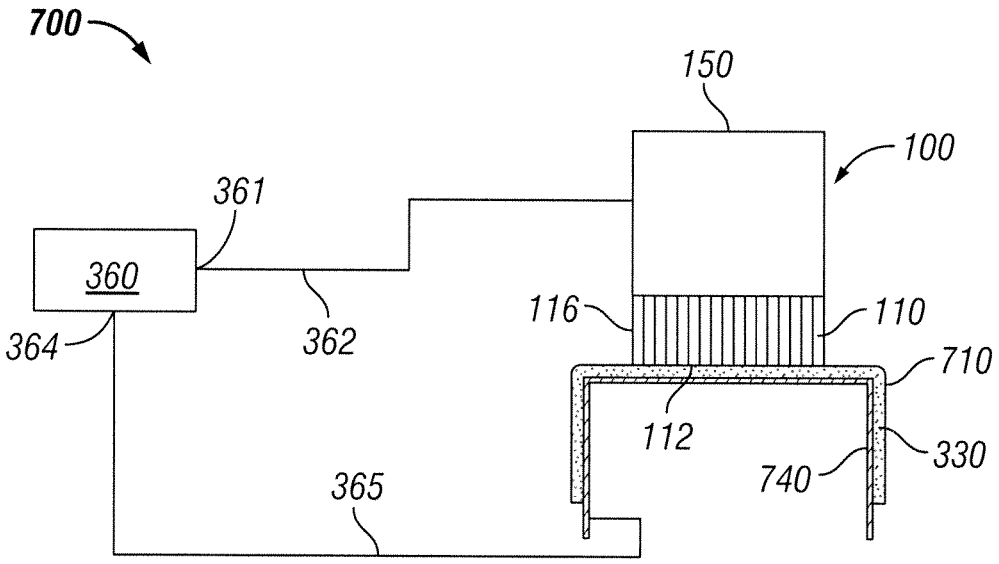
FIG. 7 is a cross-sectional view of a catalyst removal apparatus in accordance with another exemplary embodiment.

FIG. 7 is a cross-sectional view of a catalyst removal apparatus 700 in accordance with another exemplary embodiment. The catalyst removal apparatus 700 is similar to the catalyst removal apparatus 300 (FIG. 3) except that the immersion tank 320 (FIG. 3), the covering 310 (FIG. 3), the cathode 340 (FIG. 3), and the transducer 370 (FIG. 3) are removed and replaced with a metal grid 740 to function as the cathode 340 (FIG. 3) and an absorbent material 710 disposed between the metal grid 740 and the PCD cutting table 110. The absorbent material 710 is filled with electrolyte fluid 330, which provides an electrical pathway from the substrate 150 to the metal grid 740. According to certain exemplary embodiments, the transducer 370 (FIG. 3) and/or the covering 310 (FIG. 3) are optionally used in the catalyst removal apparatus 700 in the manner previously described.

The catalyst removal apparatus 700 includes the first power source 360, the PDC cutter 100 the absorbent material 710, and the metal grid 740. The metal grid 740 is fabricated using a metal that behaves as a cathode material. The absorbent material 710 is filled with electrolyte fluid 330 and placed in contact with the metal grid 740. The PDC cutter 100 includes the substrate 150 and the cutter table 110 coupled to the substrate 150, as previously mentioned. The PCD cutting surface 112 of the cutter table 110 is placed in contact with the absorbent material 710. The first power source 360 includes the positive terminal 361 and the negative terminal 364. The positive terminal 361 is electrically coupled to the substrate 150 using the first electrically conducting wire 362 and the negative terminal 364 is electrically coupled to the metal grid 740 using the second electrically conducting wire 365. Thus, an electrical pathway is formed from the positive terminal 361 to the negative terminal 364 which proceeds at least through the first electrically conducting wire 362, the substrate 150, the PCD cutting table 110, the absorbent material 710 filled with electrolyte fluid 330, the metal grid 740, and the second electrically conducting wire 365 in that order. The shape of the absorbent material 710 is changeably depending upon the design choices. For example, the absorbent material 710 is a towel or cloth material in certain exemplary embodiments, and is configured to contact only PCD cutting surface 112 of the PCD cutter 100. In another example, the absorbent material 710 is a sponge material in certain exemplary embodiments, and is configured to contact the PCD cutting surface 112 and at least a portion of the PCD cutting table outer wall 116. Additional embodiments described with respect to the catalyst removal apparatus 300 (FIG. 3) above are applicable to the catalyst removal apparatus 700 and can be used to modify the catalyst removal apparatus 700 accordingly.

Although each exemplary embodiment has been described in detail, it is to be construed that any features and modifications that are applicable to one embodiment are also applicable to the other embodiments. Furthermore, although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the exemplary embodiments. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

What is claimed is:

1. A catalyst removal apparatus, comprising:

a tank comprising a base and a wall coupled to said base forming a cavity therein;

an electrolyte fluid placed within the cavity, wherein the electrolyte fluid is a basic aqueous salt solution;

a cathode immersed in the electrolyte fluid and fabricated from a precious metal, said cathode comprising a cathode base and a cathode wall, the cathode wall coupled to the cathode base to form a cathode cavity, and wherein the cathode base comprises an aperture extending therethrough;

a component comprising a polycrystalline diamond structure and a catalyst material deposited within the polycrystalline diamond structure, at least a portion of the component being immersed within the electrolyte fluid and positioned within said cathode cavity forming a gap between the component and the cathode base and a gap between the component and the cathode wall;

a power source including a positive terminal electrically coupled to the component, thereby forming an anode, and a negative terminal electrically coupled to the cathode, wherein the electrolyte fluid is operable to react with at least a portion of the catalyst material to form a product material, the product material being soluble within the electrolyte fluid; and a transducer acoustically coupled to the component by being disposed adjacent thereto, the transducer operable to vibrate the component.

2. The catalyst removal apparatus of claim 1, wherein the component comprises a cutter, the cutter comprising a substrate having a top surface and a bottom surface and a cutting table coupled to the top surface of the substrate, wherein the cutting table comprises the polycrystalline diamond structure and the catalyst material deposited within the polycrystalline diamond structure.

3. The catalyst removal apparatus of claim 2, further comprising a covering surrounding the substrate and a portion of the cutting table, and wherein a portion of the covering is immersed into the electrolyte fluid.

4. The catalyst removal apparatus of claim 1, wherein the cathode wall surrounds the circumferential surface of at least a portion of the component.

5. The catalyst removal apparatus of claim 1, further comprising a porous material disposed between the cathode and the component, the porous material coupled to the cathode and the component.

6. A catalyst removal apparatus, comprising:

a cathode comprising a base and a wall coupled to said base and fabricated from a precious metal, said base and wall forming a cathode cavity therein;

a tank comprising a base and a wall coupled to said base forming a cavity therein;

an electrolyte fluid placed within the cavity, wherein the electrolyte fluid is a basic aqueous salt solution;

a component comprising a polycrystalline diamond structure and a catalyst material deposited within the polycrystalline diamond structure;

a transducer acoustically coupled to the component by being disposed adjacent thereto, the transducer operable to emit vibrations into the component; and a power source including a positive terminal electrically coupled to the component, thereby forming an anode, and a negative terminal electrically coupled to the cathode, wherein:

the electrolyte fluid is operable to react with at least a portion of the catalyst material to form a product material, the product material being soluble within the electrolyte fluid, the cathode is coupled to the component in a fixed relationship such that a portion of the component is positioned within the cathode cavity, and both the component and the cathode are suspended a distance from the base of the tank such that the portion of the component and the cathode are immersed within the electrolyte fluid.

7. The catalyst removal apparatus of claim 6, wherein the component comprises a cutter, the cutter comprising a substrate having a top surface and a bottom surface and a cutting table coupled to the top surface of the substrate, wherein the cutting table comprises the polycrystalline diamond structure and the catalyst material deposited within the polycrystalline diamond structure.

8. The catalyst removal apparatus of claim 7, further comprising a covering surrounding at least a portion of the circumferential surface of the cutter, the portion of the circumferential surface extending from at least the top surface towards the bottom surface, and wherein a portion of the covering is immersed into the electrolyte fluid.

9. The catalyst removal apparatus of claim 1, wherein the gap between the cathode base and component ranges from about one millimeter to about ten millimeters.

10. The catalyst removal apparatus of claim 9, further including a porous material positioned between the component and the cathode base in the gap.

11. The catalyst removal apparatus of claim 6, further comprising a porous material coupling the cathode to the component in the fixed relationship.

12. The catalyst removal apparatus of claim 11, wherein:

a gap is formed between the component and the cathode, and the gap ranges from about one millimeter to about ten millimeters.

13. The catalyst removal apparatus of claim 11, wherein:

each of the cathode and the porous material have a channel formed therethrough, and the channels are aligned.

* * * * *